US005277836A

United States Patent [19]

Peters

[11] Patent Number: 5,277,836

[45] Date of Patent: Jan. 11, 1994

[54] TERPENE CLEANING COMPOSITIONS AND METHODS OF USING THE SAME

[75] Inventor: Donald F. Peters, Lakewood, Ohio

[73] Assignee: Bio-Safe Specialty Products, Inc., Lakewood, Ohio

[21] Appl. No.: 835,797

[22] Filed: Feb. 14, 1992

[51] Int. Cl.[5] ..... C11D 1/66; C11D 1/02

[52] U.S. Cl. ..... 252/143; 252/170; 252/174.19; 252/174.21

[58] Field of Search ..... 252/143, 170, 174.19, 252/174.21

[56] References Cited

U.S. PATENT DOCUMENTS

| | | | |
|---|---|---|---|
| Re. 29,649 | 5/1978 | Farnsworth | 252/171 |
| Re. 33,210 | 5/1990 | Stoufer | 252/153 |
| 4,294,729 | 10/1981 | Bakus et al. | 252/545 |
| 4,336,151 | 6/1982 | Like et al. | 252/106 |
| 4,336,152 | 6/1982 | Like et al. | 252/106 |
| 4,362,638 | 12/1982 | Caskey et al. | 252/90 |
| 4,414,128 | 11/1983 | Goffinet | 252/111 |
| 4,455,250 | 6/1984 | Frazier | 252/106 |
| 4,511,488 | 4/1985 | Matte | 252/162 |
| 4,540,505 | 9/1985 | Frazier | 252/106 |
| 4,561,991 | 12/1985 | Herbots et al. | 252/118 |
| 4,576,738 | 3/1986 | Colodney et al. | 252/559 |
| 4,620,937 | 11/1986 | Dellutri | 252/143 |
| 4,640,719 | 2/1987 | Hayes et al. | 134/40 |
| 4,704,225 | 11/1987 | Stoufer | 252/153 |
| 4,867,800 | 9/1989 | Dishart et al. | 134/40 |
| 5,098,591 | 3/1992 | Stevens | 252/162 |
| 5,124,062 | 6/1992 | Stevens | 252/162 |
| 5,167,873 | 12/1992 | Stevens | 252/162 |

OTHER PUBLICATIONS

All purpose D-Limonen Cleaner, Chemax, Inc. (Product Data) Jul. 1987.

D-Liminene Gel Handcleaner, Chemex, Inc. (Product Data) Jun. 1987.

Water Rinsable D-Limonene Cleaner, Chemax, Inc. (Product Data) Jul. 1987.

*Primary Examiner*—Paul Lieberman

*Assistant Examiner*—Michael P. Tierney

*Attorney, Agent, or Firm*—Renner, Otto, Boisselle & Sklar

[57] ABSTRACT

This invention relates to the cleaning composition comprising a mixture of (A) at least about 10% by weight of a terpene, (B) from about 1% to about 20% by weight of a polyalkoxylated alcohol, an alkyl or alkenyl succinate, or mixtures thereof, and (C) water, wherein the mixture has an acidic pH and methods of using the same. These compositions have improved grease cutting and rust inhibiting abilities.

27 Claims, No Drawings

TERPENE CLEANING COMPOSITIONS AND METHODS OF USING THE SAME

TECHNICAL FIELD

This invention relates to terpene containing cleaning compositions with improved grease cutting ability and methods of using the same.

BACKGROUND OF THE INVENTION

Cleaners for hard and flexible surfaces must be effective in removal and/or softening of greases, tars, resins, waxes and many other contaminants on the various surfaces. Limonene is an optically active terpene closely related to isoprene. Limonene has been used in compositions for its soil removal and grease cutting abilities. Surfactants are commonly used in these cleaning solutions. The surfactants may act to enhance removal of soil or may act as a coupling agent for cleaning compositions. A coupling agent acts to produce flowable, clear, homogeneous liquid compositions.

U.S. Pat. No. 4,336,151 and 4,336,152 issued to Like et al relate to disinfectant/cleaner compositions exhibiting reduced eye irritancy potential. These compositions contain a quaternary ammonium compound, a non-ionic surfactant, d-limonene, an eye irritancy reducing compound, water and optionally a lower aliphatic alcohol. The compositions may contain from about 0.25% to about 6% by weight of d-limonene.

U.S. Pat. No. 4,414,128 issued to Goffinet relates to liquid detergent compositions which comprise 1–20% surfactant, 0.5–10% mono-or sesquiterpenes and 0.5% to 10% of a polar solvent. The polar solvent is preferably benzyl alcohol. d-limonene is listed as one of the terpene compounds and is present in a preferred amount from about 1% to about 3% by weight.

U.S. Pat. No. 4,455,250 issued to Frazier relates to disinfectant/cleaning compositions optionally containing d-limonene. The compositions generally comprise a quaternary ammonium compound, n-dodecyl guanidium hydrochloride, a specified nonionic surfactant, a lower aliphatic alcohol and water. These compositions may optionally contain from 0% to 4% by weight d-limonene.

U.S. Pat. No. 4,511,488 issued to Matta relates to d-limonene based aqueous cleaning compositions. The composition contains selected surface active agents and coupling agents. The coupling agents are glycols or lowr alkyl glycol ethers and the surface active agents are one or more anionic, nonionic surfactants. A typical cleaning composition comprises 10–60% d-limonene, 10–30% surfactant and 20–70% water, a coupling agent in an amount of 2–10 parts by weight and 2–12 parts of additives adapting the composition for particular uses.

U.S. Pat. No. 4,540,505 issued to Frazier relates to disinfectant spray cleanser containing glycol ethers. d-limonene containing aqueous pump spray compositions are rendered clear and stable by monoethers of particular aliphatic glycols.

U.S. Pat. No. 4,704,225 reissued as U.S. Pat. No. Re. 33,210 issued to Stoufer relates to cleaning compositions of terpene hydrocarbon and a coconut oil fatty acid alkanol amide having water dispersed therein. The terpene hydrocarbon is selected from limonene or dipentene, alpha-pinene, beta-pinene and mixtures of alpha- and beta-pinene, carinene, etc. The compositions contain an oil-phase consisting of 95 parts to 85 parts by weight of the terpene hydrocarbon.

It is desirable to find an environmentally safe cleaning composition with improved grease cutting ability. It is desirable to obtain this grease cutting ability without the use of coupling agents.

SUMMARY OF THE INVENTION

This invention relates to the cleaning composition comprising a mixture of (A) at least about 10% by weight of a terpene, (B) from about 1% to about 15% by weight of a polyalkoxylated alcohol, alkyl or alkenyl succinate or mixtures thereof, and (C) water, wherein the cleaning composition has an acidic pH and methods of using the same. These compositions have improved grease cutting and rust inhibiting abilities.

DETAILED DESCRIPTION OF THE INVENTION

As described above, the cleaning compositions are mixtures containing terpenes.

(A) Terpene

Terpenes are generally regarded as derivatives of isoprene wherein the isoprene units are arranged in a head-to-tail fashion. Terpenes occur naturally in all living plants. Terpenes may be acyclic, monocyclic, bicyclic, tricyclic, etc. In one embodiment, the terpenes used in this invention are monocyclic unsaturated terpenes. Examples of terpenes include alpha-pinene, beta-pinene, camphene, myrcene, dipentene (a racemic mixture of d- and l-forms of limonene), limonene, etc. In one embodiment, the terpenes useful in the present invention are a bi-product of the citrus industry and are derived from and peels of oranges, grapefruits and other citrus fruits.

In one embodiment, the terpene is a limonene. The limonene employed in the present invention is available commercially from Florida Chemical Company. In one embodiment, the limonene is d-limonene.

In another embodiment, the terpene is a Glidco available commercially from SCM Glidco Organics, Jacksonville, Fla., U.S.A. Glidsols are proprietary blends of terpenes available commercially under the tradename Glidsafe TM Glidsol. An example of commercially available Glidsols include Glidsafe TM Glidsol 180.

The terpene is generally present in an amount from at least about 10%, or about 15%, or about 18% by weight of the mixture. In one embodiment, the terpene is generally present in an amount up to about 35%, or to about 30%, or to about 25%, by weight of the mixture. In this embodiment, the terpene cleaning composition is a light duty cleaning composition. An aspect of this embodiment is the use of this light duty cleaning composition as a general purpose cleaner, such as a spray cleaner.

In another embodiment, the terpene is present in an amount from about 60%, or about 65% or about 70%, or about 75% up to about 90%, or to about 88%, or to about 85% by weight of the mixture. In this embodiment, the cleaning composition is a heavy duty cleaning composition. In an aspect of this embodiment, the cleaning composition may be useful in removing grease and oil from equipment, such as engines and heavy industrial equipment.

(B) Polyalkoxylated Alcohol and/or Alkyl or Alkenyl Succinate

The mixture additionally contains (B) a polyalkoxylated alcohol, an alkyl or alkenyl succinate, or mixtures thereof. The polyalkoxylated alcohol is generally prepared by treating an alcohol, preferably a linear alcohol, with an alkylene oxide. The alcohol of the polyoxyalkylated alcohol generally contains from 1, or about 2 to about 30 or to about 24, or about 12 carbon atoms. The polyoxyalkylated alcohol contains alkyleneoxy groups. The alkyleneoxy groups are derived from epoxides which generally contain from 2 to about 8 carbon atoms. Examples of these epoxides include ethylene oxide, propylene oxide, butylene oxide, cyclohexene oxide, styrene oxide and the like. The polyalkoxylated alcohols are preferably polyethoxylated alcohols or polypropoxylated alcohols, more preferably polyethoxylated alcohols. The polyalkoxylated alcohols generally contain an average of about 3, or about 5 up to about 30, or to about 25, or to about 15 moles of alkyleneoxy groups per mole of polyalkoxylated alcohol. The polyalkoxylated alcohols are prepared by methods known to those in the art.

The alkyl or alkenyl succinate generally contains from about 1, or about 3 to about 24, or to about 18, or to about 12 carbon atoms in the alkyl or alkenyl group. The compounds are prepared by reacting maleic anhydride, maleic acid, fumaric acid, itaconic acid, or citraconic acid with an olefin or chlorinated olefin. In one embodiment, the alkyl or alkenyl succinate is a fatty alkyl or fatty alkenyl succinate wherein the alkyl or alkenyl group contain from 8 to about 30 carbon atoms, or to about 24 carbon atoms up to about 18 carbon atoms. The alkyl or alkenyl succinates are prepared by known procedures.

In another embodiment, (B) is a mixture of polyalkoxylated alcohol and an alkyl or alkenyl succinate. Preferably, the mixture contains from one to three parts by weight of polyalkoxylated alcohol for every part of alkyl or alkenyl succinate. In a preferred embodiment, two parts of polyalkoxylated alcohol are mixed with one part of alkyl or alkenyl succinate.

In one embodiment, (B) is Triton® DF-20, which is believed to be a mixture of polyalkoxylated alcohol and alkyl succinate and available commercially from Union Carbide Chemical Company.

In the present invention, (B) is present in an amount from about 1%, or about 2% to about 20%, or to about 18%, or to about 15% by weight of the composition. In one embodiment, such as when the cleaning composition is a light duty cleaning composition, (B) is generally present in an amount from about 1%, or about 2% up to about 10%, or about 8%, or about 6% by weight of the mixture. In one embodiment, such as when the cleaning composition is a heavy duty cleaning composition, then (B) is present in an amount from about 8%, or about 10%, or about 12% up to about 20%, or about 18%, or about 15% by weight of the mixture.

(C) Water

As described above, the cleaning compositions contain (C) water. Generally, the water composes the balance of the cleaning composition. When the cleaning composition is a light duty cleaning composition, then the water is present in a major amount or an amount equal to or greater than about 55%, or about 60%, or about 65%, or about 70% by weight of the mixture. When the cleaning composition is a heavy duty cleaning composition, then the water is present in an amount from about 5%, or about 7%, or about 8% up to about 25%, or about 20%, or to about 15% by weight of the mixture.

The mixture of the present invention has a pH in the acidic range, i.e., pH $<7.0$. In one embodiment, the pH of the mixture is from 1 to about 6, or to about 5. In one embodiment, the mixture has a pH from about 2, or about 2.5 to about 5, or about 4. It has been discovered by inventor that mixtures of (A) limonene, (B) a polyalkoxylated alcohol, alkyl or alkenyl succinate, or mixtures thereof and (C) water at acidic pH have improved grease cutting abilities.

(D) Surfactant

In one embodiment, the cleaning compositions further comprise (D) a homogenizing amount of a surfactant. The surfactant is preferably an anionic surfactant, more preferably an alkyl aryl anionic surfactant. An example of a useful surfactant is an alkyl aryl sulfonate, such as alkyl benzene sulfonate. Alkyl benzene sulfonates generally have from about 6, or about 8 up to about 30, or about 24, or about 16 carbon atoms in the alkyl portion of the sulfonate. In one embodiment, the alkyl aryl surfactant is a dodecyl benzene sulfonate. An example of a useful alkyl aryl surfactant is available commercially from Mona Industries under the tradename Monamulse TM DL-1273. Generally, (D) is present in an amount from about 2%, or about 5%, or about 7% up to about 20%, or about 15%, or about 12% by weight of the mixture.

(E) Sodium Lauryl Sulfate

In another embodiment, the cleaning composition further comprises (E) sodium lauryl sulfate. Sodium lauryl sulfate provides foam properties to the cleaning compositions. The foam properties include sudsing action. Generally, the sodium lauryl sulfate is present in an amount sufficient to provide foam properties to the cleaning compositions or from about 0.5%, or about 1% up to about 5%, or about 3% by weight of the mixture.

Preparation of Composition

The mixture of the present invention may be prepared by mixing the components of a composition and shaking or homogenizing the mixture to form a emulsion or a suspension. The components may additionally be mixed in a waring blender or other mixing apparatus. Microemulsions may be prepared from the cleaning compositions of the present invention as is known to those in the art. Preferably, the (B) polyalkoxylated alcohol, the alkyl or alkenyl succinate or mixture thereof is added to (A) terpene to form a mixture, and that mixture is then added to (C) water. When (D) a surfactant and/or (E) sodium lauryl sulfate are included in the cleaning composition, (D) and/or (E) they are preferably mixed with (B) and (A) to form a mixture. The mixture is then added to water (C).

In the method of this invention, a surface, such as a hard and/or flexible surfaces, is cleaned by applying the mixture of a terpene, water and a polyalkoxylated alcohol, an alkyl- or alkenyl succinate, or mixture thereof to the surface. The mixture may be applied by spraying or pouring the mixture onto the surface. The mixture may also be placed on a cloth or brush and then applied to the surface.

In one embodiment, the cleaning compositions are free of glycol or glycol ether coupling agents. It is understood that "free of" in the specification and claims is understood to mean "substantially free of". In another embodiment, the cleaning compositions do not include coupling agents. In one embodiment, the cleaning compositions are free of amides of coconut oil fatty acids or mixtures of coconut oil fatty acids. In another embodiment, the cleaning compositions are free of quaternary ammonium compounds. In another embodiment, the cleaning compositions are free of ethoxylated and propoxylated alkylphenols. In another embodiment, the cleaning compositions are free of chlorinated solvents, such as trichloroethane and perchloroethylene. In another embodiment, the cleaning compositions are free from petroleum distillates and/or hydrocarbon oils. In another embodiment, the cleaning compositions are free of butylcellosolve (butoxyethanol).

The following examples relate to cleaning compositions of the present invention. Unless otherwise indicated, temperature is in degrees celsius, pressure is atmospheric and parts and percentages are by weight.

EXAMPLE 1

A cleaning composition is prepared by adding 22.3 parts d-limonene (food grade d-limonene available from Florida Chemical Company), 3.7 parts of Triton® DF-20 and 77.5 parts of water to a waring blender. The waring blender is run for 15 minutes to form a mixture with the appearance of a milky emulsion. The mixture has a pH of 3.4.

EXAMPLES 2 THROUGH 9

The following examples are prepared by the procedure described in Example 1.

TABLE 1

| | 2 | 3 | 4 | 5 | 6 |
|---|---|---|---|---|---|
| d-Limonene | 18 | 25 | 21 | 21 | — |
| Glidsafe TM Glidsol 180 | — | — | — | — | 20 |
| Triton ® DF-20 | 5 | 3 | 2.5 | 7 | 4 |
| Water | 80 | 76 | 79.5 | 75 | 77 |
| | 7 | 8 | 9 | 10 | 11 |
| d-Limonene | 89 | 77 | 83 | 71 | — |
| Glidsafe TM Glidsol 180 | — | — | — | — | 81 |
| Triton ® SF-20 | 15 | 15 | 12 | 20 | 17 |
| Water | 10 | 20 | 18 | 20 | 15 |

EXAMPLE 12

A cleaning composition is prepared by adding 80.4 parts d-limonene, 13.2 parts Triton® DF-20, 9.5 parts Monamulse TM DL-1273, and 9 parts of water to a waring blender. The waring blender is run for 15 minutes to form a homogenized mixture. The mixture has a pH of 3.2.

EXAMPLE 13

A cleaning composition is prepared by adding 20.2 parts d-limonene, 3.3 parts Triton® DF-20, 9.5 parts Monamulse TM DL-1273, and 69.6 parts of water to a waring blender. The waring blender is run for 15 minutes to form a homogeneous mixture. The mixture has a pH of 3.4.

EXAMPLES 14–19

The following examples are prepared by the following examples are prepared by the procedure described in Examples 12 and 13.

TABLE 2

| | 14 | 15 | 16 | 17 | 18 | 19 |
|---|---|---|---|---|---|---|
| d-Limonene | 83 | 77 | — | 18 | 21 | — |
| Glidsafe TM Glidsol 180 | — | — | 81 | — | — | 19 |
| Triton ® DF-20 | 10 | 13 | 12 | 4 | 3 | 3.5 |
| Monamulse TM DL-1273 | 9.5 | 7.5 | 8 | 9.5 | 8.6 | 9 |
| Sodium lauryl sulfate | 1 | 2 | 1.5 | 1.5 | 1 | 2 |
| Water | 9 | 12 | 10 | 70 | 69 | 70 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. A cleaning composition comprising a mixture of (A) at least about 10% by weight of a terpene, (B) from about 1% to about 20% by weight of a polyalkoxylated alcohol, an alkyl or alkenyl succinate, or a mixture thereof, and (C) water, wherein the mixture has an acidic pH and wherein the mixture does not include any coupling agents.

2. The composition of claim 1 wherein the terpene (A) is a monocyclic terpene.

3. The composition of claim 1 wherein the terpene (A) is limonene.

4. The composition of claim 1 wherein (B) is a polyalkoxylated linear alcohol.

5. The composition of claim 1 wherein (B) is a polyalkoxylated alcohol derived from an alcohol having 1 to about 30 carbon atoms.

6. The composition of claim 1 wherein (B) is a polyalkoxylated alcohol containing an average from about 3 to about 30 moles of alkyleneoxy groups per mole of polyalkoxylated alcohol.

7. The composition of claim 1 wherein (B) is a mixture of a polyethoxylated alcohol and an alkyl or alkenyl succinate.

8. The composition of claim 1 wherein (A) is present in an amount from about 12% to about 25% by weight, (B) is present in an amount from about 1% to about 10% by weight, and (C) is present in a major amount.

9. The composition of claim 1 wherein (A) is present in an amount from about 60% to about 75% by weight, (B) is present in an amount from about 8% to about 20% by weight, and (C) is present in an amount from about 5% to about 20% by weight.

10. The composition of claim 1 wherein the pH of the mixture is from 1 to about 6.

11. The composition of claim 1 wherein the mixture further comprises (D) a homogenizing amount of a surfactant.

12. The composition of claim 1 further comprising (E) from about 0.5% to about 5% by weight of sodium lauryl sulfate.

13. A cleaning composition comprising a mixture of (A) from about 10% to about 35% by weight of a terpene, (B) from about 2% to about 10% by weight of a polyalkoxylated alcohol, an alkyl or alkenyl succinate or a mixture thereof, and (C) a major amount of water, wherein the mixture has an acidic pH and wherein the mixture does not include any coupling agents.

14. The composition of claim 13 wherein the terpene (A) is a monocyclic terpene.

15. The composition of claim 13 wherein the terpene (A) is limonene.

16. The composition of claim 13 wherein (B) is a mixture of a polyethoxylated alcohol and an alkyl or alkenyl succinate.

17. The composition of claim 13 wherein (C) is present in an amount equal to or greater than 60% by weight.

18. The composition of claim 13 wherein the mixture further comprises (D) a homogenizing amount of a surfactant.

19. The composition of claim 13 further comprising (E) from about 0.5% to about 5% by weight of sodium lauryl sulfate.

20. The composition of claim 13 wherein (A) is present in an amount from about 15% to about 30% by weight, and (B) is present in an amount from about 2% to about 8% by weight.

21. A cleaning composition comprising a mixture of (A) from about 60% to about 90% by weight of a terpene, (B) from about 8% to about 20% by weight of a polyalkoxylated alcohol, an alkyl or alkenyl succinate, or mixtures thereof, and (C) water, wherein the mixture has an acidic pH and wherein the mixture does not include any coupling agents.

22. The composition of claim 21 wherein the terpene (A) is a monocyclic terpene.

23. The composition of claim 21 wherein the terpene (A) is limonene.

24. The composition of claim 21 wherein (B) is a mixture of a polyethoxylated alcohol and an alkyl or alkenyl succinate.

25. The composition of claim 21 wherein the mixture further comprises (D) a homogenizing amount of a surfactant.

26. The composition of claim 21 further comprising (E) from about 0.5% to about 5% by weight of sodium lauryl sulfate.

27. A method of cleaning surfaces comprising the steps of (1) preparing a mixture of (A) at least about 10% by weight of a terpene, (B) from about 1% to about 20% by weight of a polyalkoxylated alcohol, an alkyl or alkenyl succinate, or mixture thereof, and (C) water, wherein the mixture has an acidic pH and wherein the mixture does not include any coupling agents and, (2) applying the mixture to a surface.

* * * * *